United States Patent [19]

Yarrington

[11] Patent Number: 4,984,518

[45] Date of Patent: Jan. 15, 1991

[54] ELECTRO-OPTICAL DETONATOR

[76] Inventor: Arthur G. Yarrington, MS 1073, Crows Nest, Queensland 4355, Australia

[21] Appl. No.: 460,567

[22] Filed: Jan. 3, 1990

Related U.S. Application Data

[63] Continuation-in-part of Ser. No. 283,278, filed as PCT AU88/00067 on Mar. 11, 1988, abandoned.

[30] Foreign Application Priority Data

Mar. 17, 1987 [AU] Australia ..... PI0881

[51] Int. Cl.[5] ..... F42C 19/00

[52] U.S. Cl. ..... 102/201

[58] Field of Search ..... 102/210, 202.5, 202.9, 102/206

[56] References Cited

U.S. PATENT DOCUMENTS

| | | | |
|---|---|---|---|
| 3,362,329 | 1/1968 | Epstein | 102/201 |
| 3,408,937 | 11/1968 | Lewis et al. | 102/201 |
| 4,085,680 | 4/1978 | Ziemba | 235/456 |
| 4,621,578 | 11/1986 | Vallieres et al. | 102/202.9 |

FOREIGN PATENT DOCUMENTS

| | | | |
|---|---|---|---|
| 2913231 | 10/1979 | Fed. Rep. of Germany | 102/202.5 |
| 3342819 | 6/1985 | Fed. Rep. of Germany | 102/201 |

*Primary Examiner*—Charles T. Jordan
*Assistant Examiner*—Stephen Johnson

[57] ABSTRACT

A detonator for explosive compositions comprises an outer jacket containing a charge of explosive detonating material which is initiated by a deflagratory primer composition ignitable by an electrical resistance element. The electrical resistance element is coupled with a photo-conductive diode or transistor to close an electrical circuit to initiate detonation in response to laser radiation transmitted to the photo-conductive diode or transistor via an optical light guide.

7 Claims, 1 Drawing Sheet

ELECTRO-OPTICAL DETONATOR

Figure 1:
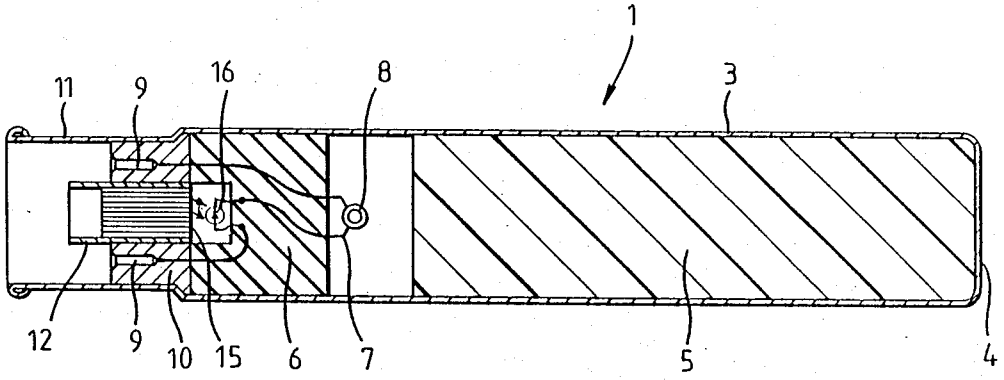

This case is a continuation-in-part application from U.S. Pat. application Ser. No. 07/283,278, filed as PCT AU88/00067 on Mar. 11, 1988, now abandoned.

This invention is concerned with a detonator for explosive compositions and in particular is concerned with a detonator which employs as a fail safe device, an optically actuated switching means to close an electrical energizing circuit.

Electrically actuated detonators comprising a thermo resistive element coated with an initiation or "flashing" compound are well known. Such devices are inexpensive to manufacture and are known to be extremely reliable in use as well as relatively safe in storage and handling.

The major disadvantage with electrically actuated detonators is that they require connection via electrically conductive cables to remote detonating device providing a source of electrical energy. Accidental explosions have been attributed to spurious electrical currents induced or conducted in the electrical conductors by electrical machinery, station earth charges, lightning, high voltage transmission line corona discharge, radio frequency transmissions and the like.

In an endeavour to overcome the dangers associated with conventional electrically actuated detonators of the type described above, various non-electric systems have been proposed.

One type of non-electrically actuated detonator employs a tubular lead, the inner surface of which is coated with a deflagrating material. When the deflagrating material is ignited at a remote end of the tubular lead, a shook wave is propagated down the interior of the tubular lead to detonate the explosive composition. A non-electrical blasting initiating system of this type is described in U.S. Pat. No. 4,757,764.

While generally effective for its purpose and relatively safe in use, such non-electric deflagrating "fuses" are not suitable for precise time delay explosive applications.

Swedish Patent Application Number 8503595 describes a fibre-optic ignition system for explosive compositions wherein optical energy is converted by a photo-voltaic cell into electrical energy. The electrical energy is amplified and stored in a capacitor for selective release via electrical conductors to a conventional electric detonator. While this system avoids the necessity for use of long electrical conductors between the detonator and a remote initiating position (with the attendant risks described above), the system still requires the use of electrical conductors between the optical initiating device and the detonator.

The formation of a continuous electrically conductive circuit between the electrical switching means of the optical initiating device and the detonator is considered to pose an unacceptable risk of premature detonation from spurious induced or conductive currents in the electrical conductors.

U.S. Pat. Nos. 3812783, 4391195, 4403143 and 3408937 are illustrative of non-electric blast initiation systems employing high intensity laser radiation transmitted via an optical fibre cable to a detonating device.

Prior art blast initiation systems employing laser energy as a sole energizing source are relatively safe in use but currently are uneconomical in use and of dubious reliability.

It is an aim of the present invention to overcome or alleviate the problems of prior art blast initiation systems and to provide a safe, reliable and economic explosives detonator and initiation system therefor.

According to the invention there is provided a detonator comprising:

a hollow body portion having a closure at a distal end and an opening at a proximal end; a quantity of explosive detonating material located within said body portion adjacent said distal end;

an electrical resistance element spaced from said quantity of detonating material, said electrical resistance element having associated therewith a quantity of thermally energizable initiating pyrotechnic material; and, switching means responsive to electromagnetic radiation, said switching means being coupled with said electrical resistance element to selectively close an electrical circuit associated with said resistance element in response to energization by a source of electromagnetic radiation.

Preferably said switching means comprises a photoconductive device.

Suitably said photo-conductive device comprises a photo-conductive diode, photo-conductive thyristor or the like.

Preferably said detonator includes terminals for connecting a source of electrical energy to said electrical circuit associated with said resistance element.

preferably said detonator includes at least one terminal for connection to an electromagnetic conductor.

Suitably said terminal for connection to an electromagnetic conductor is adapted for connection to a fibre optic light guide.

In order that the invention may be more clearly understood, reference will now be made to a preferred embodiment illustrated in the accompanying drawings.

Figure 2:
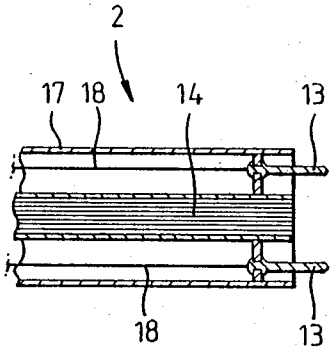

FIG. 1 illustrates in cross section a detonator according to the invention and FIG. 2 illustrates (schematically) portion of a free end of a composite electrical/-fibre optic conductor.

Detonator 1 comprises a hollow body portion 3 having a closed distal end 4 adjacent which is located a quantity of explosive detonating material 5.

A plug or wad 6 of rubber, plastics papier mache or the like supports an electrical resistance element 7 which is coated with a deflagratory initiating pyrotechnic material 8 of the type commonly employed in prior art electric detonators top initiate fusion of the detonating material 5.

Electrical connection to resistance element 7 is achieved by means of terminals 9 located in a moisture proof sealing plug 10 mounted near the proximal end of body portion 3. As shown, terminals 9 are formed as sockets to receive mating electrical plug terminals 13 of the composite electrical/fibre optic conductor 2.

Also located in plug 10 is a terminal 12 for the fibre optic light guide 14 of composite conductor 2. The inner end !5 of terminal 12 is open or optically transparent to permit electromagnetic energy in a suitable form, such as laser light, to impinge on a photo-conductor 16 such as a photo-conductive diode or photo-conductive thyristor to close the electrical circuit between terminals 9 when photoconductor 16 is energized.

The composite conductor 2 suitably comprises a hollow tubular protective outer sheath 17 of suitable material such as extruded plastics or the like surrounding a pair of electrical conductors !8 and a fibre optic light guide 14.

Alternatively, the electrical conductors and fibre optic conductor may be connected to the respective terminals on the detonator as separate conductors rather than a composite conductor.

In use the detonator 1 is connected to free ends of electrical and optical conductors, the opposite ends of which conductors are connected at a remote position to a source of electrical energy and a source of laser radiation respectively.

With a suitable voltage of say 12–32 volts D.C. connected across the electrical conductors, a source of high intensity light such as laser radiation is transmitted through the optical conductor to cause the electrical circuit associated with resistance element 7 to be closed, thus initiating detonation of the detonator.

It will be appreciated by a skilled addressee that even though the detonator according to the present invention is structurally and otherwise functionally identical to a prior art electric detonator, the inherent dangers associated with spurious electrical charges are avoided by the incorporation in the detonator of a controllable switching means to close the electrical circuit. Although the electrical conductors may be exposed to such spurious electrical charges there is no risk of premature detonation.

The detonators according to the present invention thus possess the advantages of prior art electrical detonators in terms of reliability and economy but otherwise avoid the dangers inherent therein.

It will be clear to a skilled addressee that many modifications and variations may be made to the present invention without departing from the spirit and scope thereof.

For example, an alternative source of high intensity light may comprise a Xenon flash tube of the type employed in photographic flash units or signalling beacons.

The claims defining the invention are as follows:

1. A detonator comprising:

a hollow body portion having a closure at a distal end and an opening at a proximal end; a quantity of explosive detonating material located within said body portion adjacent said distal end;

an electrical resistance element spaced from said quantity of detonating material, said electrical resistance element having associated therewith a quantity of thermally energizable initiating pyrotechnic material: and, switching means responsive to electromagnetic radiation, said switching means being coupled with said electrical resistance element to selectively close an electrical circuit associated with said resistance element in response to energization by a source of electromagnetic radiation.

2. A detonator as claimed in claim 1 wherein said switching means comprises photo-conductive device.

3. A detonator as claimed in claim 2 wherein said photo-conductive device comprises a light activated diode.

4. A detonator as claimed in claim 2 wherein said photo-conductive device comprises a light activated thyristor.

5. A detonator as claimed in claim 3 including terminals for connection to respective conductors of electrical energy and electromagnetic radiation.

6. A detonator as claimed in claim 4 including terminals for connection to respective conductors of electrical energy and electromagnetic radiation.

7. A detonator as claimed in claim 2 wherein said switching means is responsive to electromagnetic radiation having a frequency in a visible range.

* * * * *